US011552409B2

(12) United States Patent
Smith

(10) Patent No.: US 11,552,409 B2
(45) Date of Patent: Jan. 10, 2023

(54) END-FIRE WIDEBAND DIRECTIONAL ANTENNA

(71) Applicant: Airbus SAS, Blagnac (FR)

(72) Inventor: Leslie Smith, Blagnac (FR)

(73) Assignee: Airbus SAS, Blagnac (FR)

( * ) Notice: Subject to any disclaimer, the term of this patent is extended or adjusted under 35 U.S.C. 154(b) by 19 days.

(21) Appl. No.: 17/211,943

(22) Filed: Mar. 25, 2021

(65) Prior Publication Data

US 2021/0305716 A1 Sep. 30, 2021

(30) Foreign Application Priority Data

Mar. 27, 2020 (FR) ..... 2003063

(51) Int. Cl.
*H01Q 19/30* (2006.01)
*H01Q 1/28* (2006.01)
*H01Q 1/48* (2006.01)

(52) U.S. Cl.
CPC ..... *H01Q 19/30* (2013.01); *H01Q 1/286* (2013.01); *H01Q 1/48* (2013.01)

(58) Field of Classification Search
CPC ..... H01Q 19/10–30; H01Q 1/28; H01Q 1/48
See application file for complete search history.

(56) References Cited

U.S. PATENT DOCUMENTS 4,218,686 A * 8/1980 Blonder ..... H01Q 1/1228 343/893
5,008,681 A * 4/1991 Cavallaro ..... H01Q 19/005 343/819
5,220,335 A * 6/1993 Huang ..... H01Q 1/38 343/834
6,307,524 B1 * 10/2001 Britain ..... H01Q 19/30 343/819
7,023,396 B2 4/2006 Thudor et al.
8,228,254 B2 7/2012 Foltz et al.
2011/0057848 A1 * 3/2011 Baucom ..... H01Q 19/30 343/705
2014/0043197 A1 2/2014 Lee et al.
2016/0189915 A1 * 6/2016 Kim ..... H01Q 19/30 315/34
2019/0280365 A1 9/2019 Song et al.
2020/0059009 A1 * 2/2020 Sonoda ..... H01Q 19/10

OTHER PUBLICATIONS

French Search Report; priority document.
Nuangpirom Pinit et al., "A Dual-Band Microstrip Fed Monopole Quasi-Yagi Antenna" 2018 International Electrical Engineering Congress, Mar. 7, 2018, pp. 1-4.

* cited by examiner

*Primary Examiner* — Hasan Islam
(74) *Attorney, Agent, or Firm* — Greer, Burns & Crain, Ltd.

(57) ABSTRACT

A Yagi-Uda monopolar antenna configured to be mounted on the conductive surface of a vehicle, especially an aircraft. The antenna comprises: a radiating element, taking the form of a conductive plate, for example one having the shape of a disc, which plate is equipped with a return conductor; a reflecting element; and at least one directing element taking the form of a monopole that is folded on itself. The various elements are mounted on a substantially planar surface such as the skin of the fuselage of an aircraft. The antenna simultaneously has a wide operating band, a good compactness and a good directivity. It may especially serve as joint antenna for a plurality of air-ground communication systems of an aircraft.

10 Claims, 3 Drawing Sheets

END-FIRE WIDEBAND DIRECTIONAL ANTENNA

CROSS-REFERENCES TO RELATED APPLICATIONS

This application claims the benefit of the French patent application No. 2003063 filed on Mar. 27, 2020, the entire disclosures of which are incorporated herein by way of reference.

FIELD OF THE INVENTION

The present invention relates to the general field of antennas and more particularly to end-fire antennas of Yagi-Uda type. The antenna according to the present invention may advantageously be installed on-board an aircraft in order to allow air-ground communications in a wide frequency band.

BACKGROUND OF THE INVENTION

The increasing number of communications systems installed on-board vehicles requires it to be possible to transmit and receive in a plurality of frequency bands, this generally requiring as many antennas to be installed on a vehicle as it comprises separate communication systems, this multiplication of antennas representing a source of complexity both with respect to installation and with respect to maintenance. It may thus be advantageous, a fortiori, when the intended recipients of these communications are co-located or close in terms of angle of sight, to use a joint antenna common to all of these communication systems. Thus, for example, on-board an aircraft, a plurality of air-ground communication systems using separate frequency bands may share one wideband joint antenna. Another advantage of such sharing is a smaller protrusion at the surface of the aircraft and therefore a lower drag.

Moreover, it is often preferable for on-board antennas to have a high directivity and therefore a high gain, so as to decrease power consumption and to increase signal-to-noise ratio. Generally, since the gain of an antenna is proportional to the effective aperture cross-sectional area of the antenna, which itself is proportional to the area of the antenna in the plane orthogonal to the direction of the main lobe, the search for high-directivity antennas leads to antennas with large dimensions in the plane orthogonal to that of the emission direction. In the aforementioned case of communications between an aircraft and ground, the main lobe of the antenna must have a small angle of elevation and the aperture area of the antenna must therefore be large in a plane orthogonal to the longitudinal axis of the aircraft, this increasing drag and therefore fuel consumption.

The Yagi-Uda antenna, which was initially developed for the aeronautical field and which has since been universally used as a TV antenna, is an antenna having both a good directivity and a relatively small aperture area. Specifically, it is known to those skilled in the art that this type of antenna is composed of a half-wave linear dipole, which is generally folded, of a reflecting parasitic element located behind and of one or more directing parasitic elements located in front of this dipole, all of these being mounted on the same boom, the direction of the main lobe being given by the direction of the boom. The reflecting element has a larger lateral extent than that of the dipole, the latter having a larger lateral extent than that of the directing elements. The reflecting and directing parasitic elements act as radiating dipoles that are fed by induction by the half-wave dipole, which is alone wire-fed. The Yagi-Uda antenna may be likened, to a first approximation, to an antenna array, the elements of which are fed by mutual induction. By suitably choosing the position and spacing between the various elements, the waves emitted by the various elements add constructively in the direction of the boom and destructively in the inverse direction.

However, one major drawback of Yagi-Uda antennas is their narrow-band operation, making them unusable as a joint wideband antenna in the preceding sense. Specifically, their fractional bandwidth, or in other words the ratio between their bandwidth and their central frequency, is about 10%.

One objective of the present invention is therefore to provide an antenna possessing a small effective aperture cross-sectional area while nonetheless having a wide operating band and a high directivity.

SUMMARY OF THE INVENTION

The present invention is defined by a Yagi-Uda antenna comprising a radiating element, a reflecting parasitic element and at least one directing parasitic element, which elements are placed in this order along a longitudinal axis of the antenna, the antenna being specific in that the radiating element is formed by a conductive plate, placed substantially orthogonal to the longitudinal axis of the antenna and above a ground plane so as to form a monopole, the plate being provided, on the side of the ground plane, with a feed terminal for applying or receiving an antenna signal.

The conductive plate is advantageously of circular, ellipsoidal or rectangular shape and is equipped, at an end opposite to the ground plane, with a return conductor, the return conductor being electrically connected to the ground plane, so that the assembly consisting of the conductive plate and the return conductor forms a folded monopole.

In particular, the conductive plate may take the form of a disc of diameter of about $\lambda/4$ where $\lambda$ is a wavelength corresponding to the lower limit of the operating frequency band of the antenna, the return conductor taking the form of a rod or a strip of length substantially identical to the diameter of the disc.

According to a first variant, the return conductor extends parallel to the disc and is located therebehind, between the disc and the reflecting parasitic element.

According to a second variant, the return conductor extends parallel to the disc and is located in front thereof, between the disc and the directing parasitic element.

Advantageously, the reflecting parasitic element has, in the direction perpendicular to the ground plane, a dimension larger than that of the conductive plate in the same direction.

Preferably, the directing parasitic element is configured as a folded monopole, comprising a first conductive segment and a second conductive segment that are parallel to each other and to the conductive plate, the first and second conductive segments being connected at a common first end, on the side opposite to the ground plane, and not being connected at their second ends, on the side of the ground plane.

The conductive plate may have a disc shape and the first and second conductive segments have a length smaller than the diameter of this disc.

The operating passband of the Yagi-Uda antenna will possibly cover more than one octave.

Lastly, the invention also relates to an aircraft on which is mounted a Yagi-Uda antenna such as described above, the antenna being mounted on the lower portion of the fuselage of the aircraft, the longitudinal axis of the antenna being substantially parallel to the longitudinal axis of the aircraft, and the ground plane comprising the skin of the fuselage.

BRIEF DESCRIPTION OF THE DRAWINGS

Other features and advantages of the invention will become apparent on reading the description of one preferred embodiment of the invention, which is described with reference to the appended figures, in which.

DETAILED DESCRIPTION OF THE PREFERRED EMBODIMENTS

A first idea behind the invention is to modify a Yagi-Uda antenna, by choosing as radiating element a conductive plate so as to make the antenna wideband without, however, making it lose its directivity properties. A second idea behind the invention is to decrease the lateral extent of this antenna, by using a ground plane to achieve a monopolar configuration. The fact that the ground plane is naturally available in the form of a conductive surface of the vehicle itself makes this monopolar configuration all the more advantageous.

Thus, the wire-fed linear dipole of the Yagi-Uda antenna is here replaced, in an original manner, by a monopolar plate antenna, which advantageously is chosen to be of circular shape.

Figure 1:
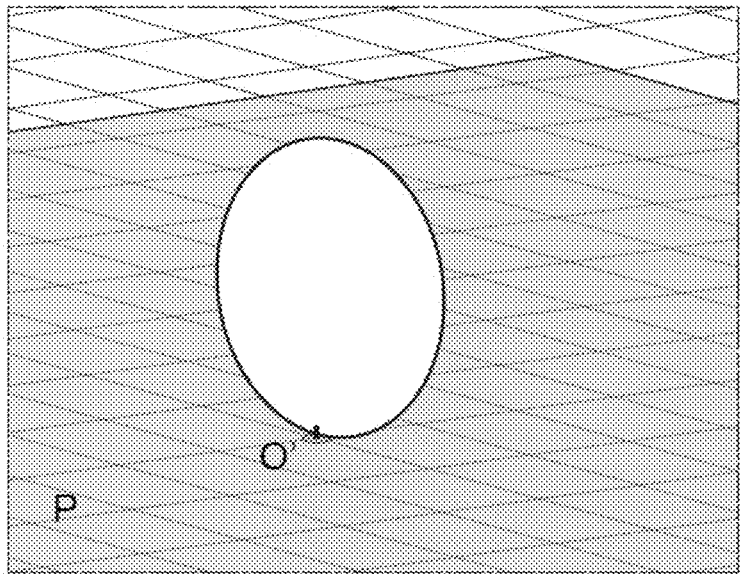
FIG. 1 schematically shows a disc-shaped monopolar plate antenna.

A monopole taking the form of a radiating disc located above a ground plane, such as schematically illustrated in FIG. 1, will first be considered. This disc is fed, at its lower end O', with an antenna signal via a hole produced through the ground plane P. In a manner known per se, the radiation pattern of such a monopole is identical to an equivalent dipole consisting of the monopole and of its image with respect to the ground plane.

Figure 2:
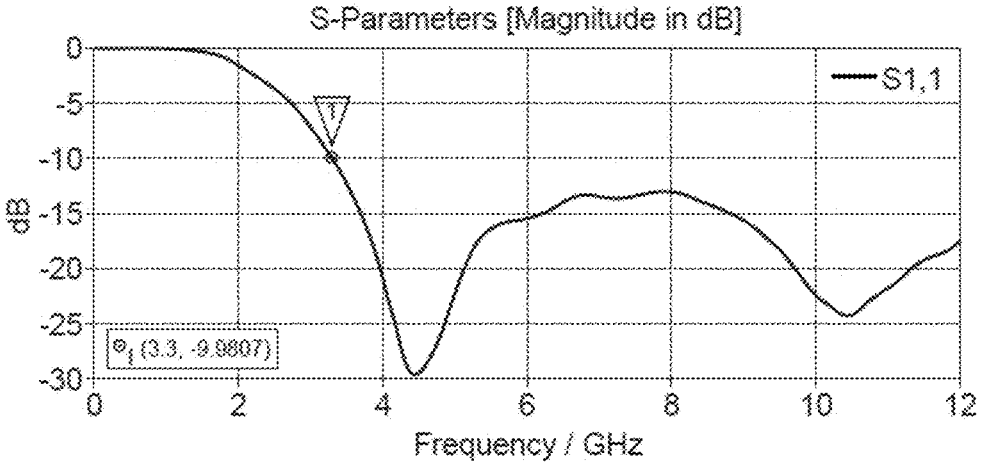
FIG. 2 shows a graph giving the reflection coefficient of the antenna of FIG. 1 as a function of frequency.

The operating passband of the circular plate antenna is substantially larger than that of a monopole of height equal to the diameter of the antenna in question. By way of example, a graph giving the reflection coefficient (magnitude in decibels of the parameter $S_{11}$) of the antenna of FIG. 1 as a function of the frequency of the antenna signal has been shown in FIG. 2, for a disc diameter of 20 mm. It will be noted that the width of the operating band measured at 10 dB extends over a frequency range starting at about 3.3 GHz and ending above 12 GHz.

Figure 3:
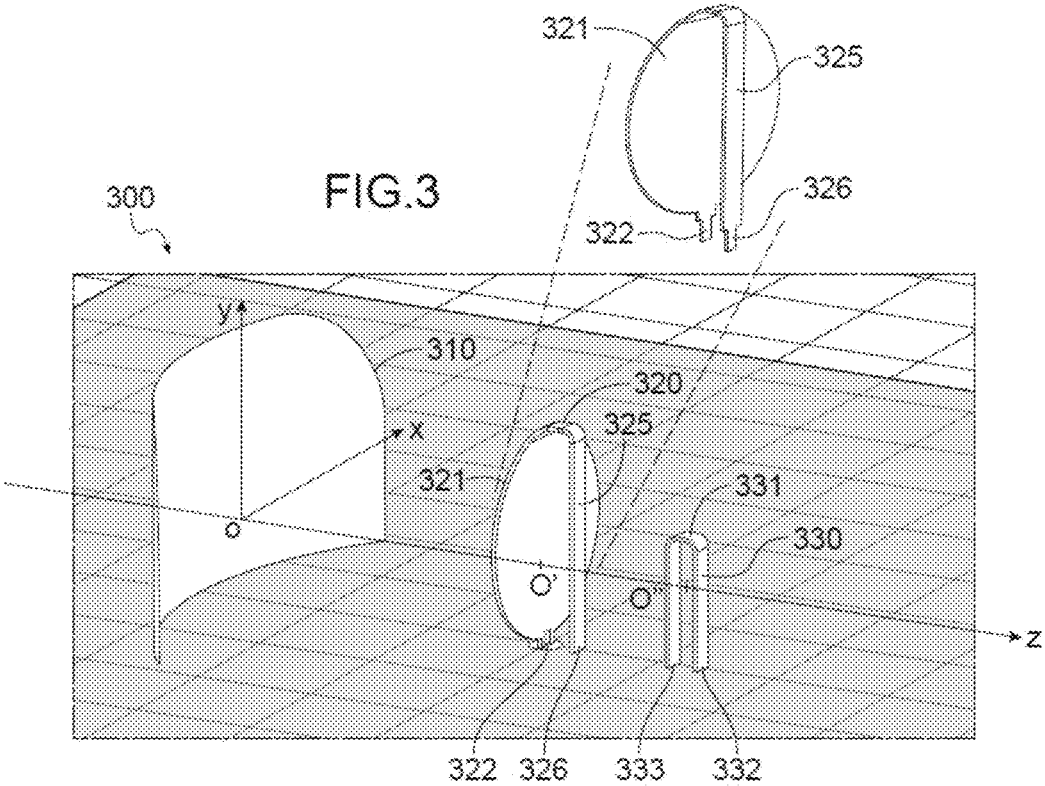
FIG. 3 schematically shows a wideband end-fire antenna according to one embodiment of the invention.

FIG. 3 schematically shows a wideband end-fire antenna according to one embodiment of the invention.

Advantageously, the antenna has a monopolar configuration in the sense that it is located above a conductive plane P that plays the role of ground plane. The term "above" is here purely relative and the antenna will possibly be located under the conductive plane. For example, if the ground-communication antenna is mounted under the fuselage of an aircraft, it will be understood that the antenna in question will be located under the conductive plane formed by the skin of the fuselage.

The shown antenna, 300, is an end-fire antenna in the sense that the signal emitted by the antenna will be emitted in the direction Oz. In the case of mounting on an aircraft, the direction Oz will possibly be substantially parallel to the longitudinal axis of the aircraft and point toward the front or else the rear thereof. Alternatively, the antenna will possibly point in a lateral direction.

The antenna comprises a radiating element, 320, taking the form of a wire-fed plate. This radiating element is the only element of the antenna to be fed directly, the other elements being fed solely by induction. Advantageously, the radiating element 320 has a disc shape although other shapes may also be envisaged. For example, the radiating element will possibly take the form of an ellipsoidal or rectangular plate.

In the case of a disc, the diameter will be chosen to be about $\lambda/4$, where $\lambda$ is the wavelength corresponding to the lower limit of the operating band of the antenna. In the case of an ellipsoidal or rectangular plate, the dimensions along the axes Ox and Oy orthogonal to the longitudinal axis Oz will be chosen so that the resonant frequencies, of transverse modes, in the directions in question, are located in the frequency band used.

Advantageously, the radiating element 320 will advantageously be mounted in a folded form achieved by means of a return conductor 325 placed substantially parallel to the plate 321 and the transverse dimension of which in the direction Ox is small. For example, the return conductor 325 will possibly consist of a conductive rod of small diameter or of a rigid conductive strip of small width. The lower end 326 of the return conductor 325 is electrically connected to a ground plane. To emit, the antenna signal is applied across the lower end 322 and the ground plane. Similarly, to receive, the antenna signal is picked up across the end 322 and the ground plane.

The folded form of the radiating element 320 is an advantageous feature of the invention. Specifically, this form allows the impedance of the radiating element of the known prior-art monopole to be increased. Specifically, if the impedance of a monopole disc is about 37 ohms, that of this monopole in the folded configuration is four times higher.

The return conductor 325 will possibly be located in front of the plate 321 of the monopole in the direction of the longitudinal direction Oz. For example, the return conductor will possibly extend parallel to the plate and be located in front thereof, between the plate (for example a disc) and the directing parasitic element Alternatively and preferably, this return conductor will be located behind the plate, between the plate (for example a disc) and a passive reflecting element, described below, so as not to obstruct propagation in the longitudinal direction.

The antenna also comprises a passive reflecting element, 310, also referred to as a parasitic reflecting element, located behind the radiating element. This reflecting element will possibly also take various forms. Generally, the reflecting element will possess a vertical dimension (i.e., a dimension in the direction Oy perpendicular to the ground plane) that is larger or even simply slightly larger than the vertical dimension of the plate 321. For example, the vertical dimension of the reflecting element will possibly exceed by 5% that of the radiating plate. More generally, the reflecting element will possess transverse dimensions (perpendicular to the axis Oz) larger than those of the radiating plate.

Thus, when the plate 321 is of disc shape, the reflecting element 310 will possibly have the shape of a disc of larger diameter or even of a paraboloid having an effective cross-sectional area of larger diameter and an axis of revolution coincident with the longitudinal axis Oz.

Alternatively, when the plate 321 has an ellipsoidal shape, the reflecting element will possibly also have an ellipsoidal shape, the lengths of the major axis and minor axis of which are larger than the lengths of the major axis and minor axis of the plate, respectively. In this case as well, the reflecting element will possibly also take the form of a paraboloid that is flattened in the direction of the minor axis of the plate and that has an axis of symmetry coincident with the longitudinal axis Oz. In both cases, the major axis of the ellipsoid or of the cross section of the paraboloid will advantageously be chosen orthogonal to the ground plane.

Lastly, the plate 321 will possibly have the shape of a cylindrical segment, a hemicylinder for example, with an axis of revolution perpendicular to the ground plane, the cylindrical segment being open in the direction of the longitudinal axis Oz.

Advantageously, the antenna 300 furthermore comprises one or more directing elements 330. These directing elements may each take the form of a vertical rod of any diameter or, preferably, of a linear structure folded on itself, which has the advantage of being stronger and lighter. In this case, such a directing element 330 comprises a first segment that lies perpendicular to the ground plane, taking the form of a conductive rigid strip or of a rod, and a parallel second conductive segment of the same form, located at a small distance from the first. The first and second segments are connected together at a common first end 331 on the side opposite the ground plane. In contrast, the respective second ends, 332 and 333, of the first and second segments located on the side of the ground plane are not connected together.

Generally, using linear elements folded on themselves allows the overall rigidity of the antenna to be improved.

The transverse dimensions of the directing elements 330 in a plane orthogonal to the axis Oz are chosen to be smaller or even slightly smaller than the respective transverse dimensions of the radiating plate 321. For example, when the plate possesses a circular, ellipsoidal or rectangular shape, the first and second segments of a directing element have a length that is about 5% shorter than the diameter of the circle, the minor side of the ellipse or the short side of the rectangle in the direction of the axis Oy.

The reflecting element, 310; the radiating element, 320, which is composed of the plate antenna; and the one or more directing elements, 330, are advantageously mounted on a substantially flat surface, such as, for example, a ground plane or the skin of an aircraft, that is directed in the direction Oz and form a monopolar Yagi-Uda antenna.

The relative positions of the elements along the axis Oz and their spacings are chosen so as to optimize the shape of the beam, and especially so as to reduce the side lobes thereof and to allow impedance matching (generally to 50Ω). The introduction of directing elements and of a reflecting element into the field of the radiating element decreases the impedance of the antenna and therefore non-radiated power. The radiating element possesses a high impedance, of about 150Ω, this allowing directing elements 330 and a reflecting element 310 to be used while decreasing non-radiated power.

The various elements of the antenna may be produced simply and at low cost from metal strips or sheets.

Figure 4:
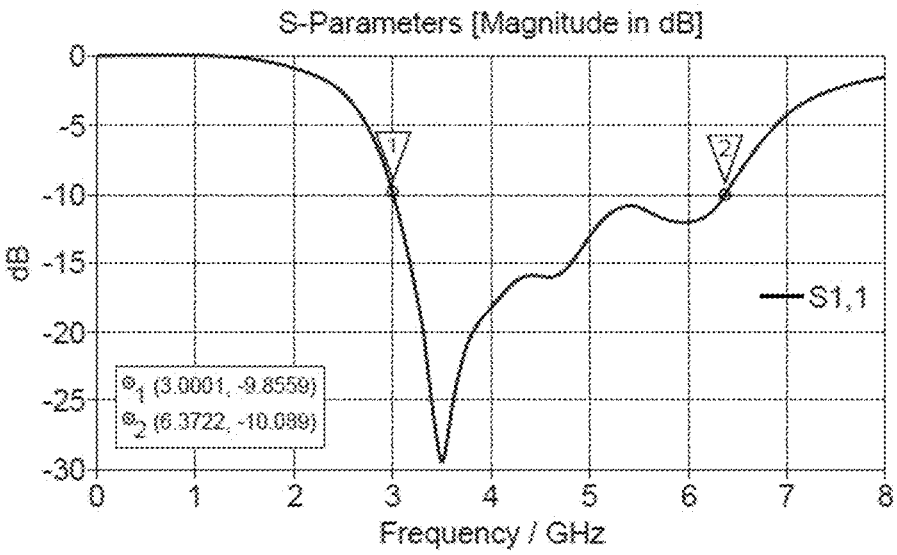
FIG. 4 shows a graph giving the reflection coefficient of the antenna of FIG. 3 as a function of frequency.

FIG. 4 shows a graph giving the reflection coefficient (parameter $S_{11}$) of the antenna of FIG. 3 as a function of frequency.

The radiating plate comprises a metal disc of 20 mm diameter. The antenna furthermore comprises a hemicylindrical reflecting element and a directing element. It will be noted in FIG. 4 that the width of the operating band measured at 10 dB extends over one octave from 3 to 6 GHz. It therefore encompasses most of the 4G and 5G frequency bands used worldwide.

Thus, the proposed antenna may especially serve as a joint antenna for a plurality of on-board air-ground communication systems, in particular when the aircraft is in approach phase. This antenna may also serve as a relay antenna in the case of use of mobile phones by passengers of the aircraft.

Figure 5:
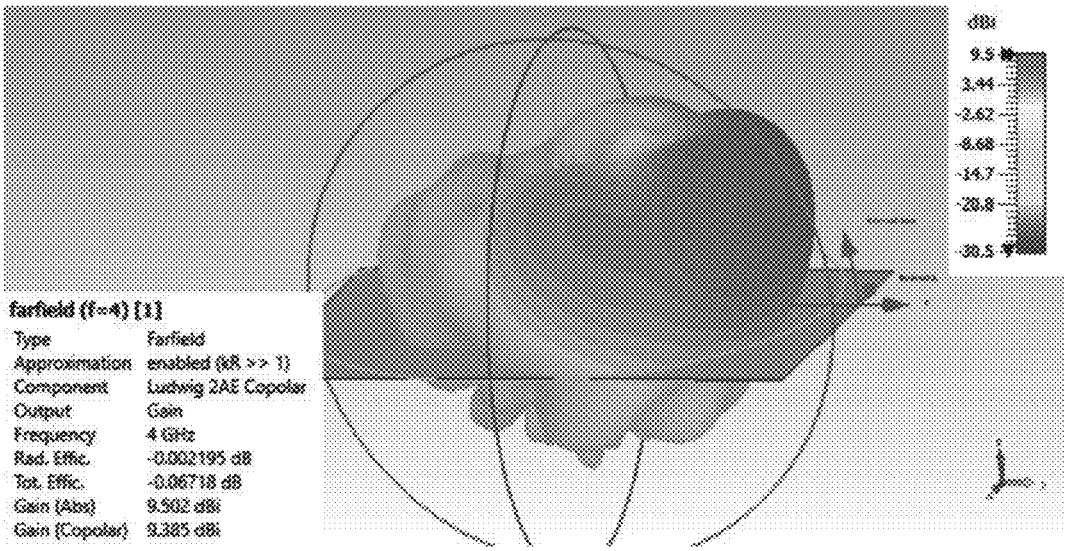
FIG. 5 shows the three-dimensional radiation pattern of the antenna of FIG. 3.

FIG. 5 shows the three-dimensional radiation pattern of the antenna of FIG. 3 at a frequency of 4 GHz.

It will be noted that the antenna has a good directivity at low and medium elevation, and an end-fire emission in the direction of the axis Oz with a gain of close to 10 dB.

Figure 6:
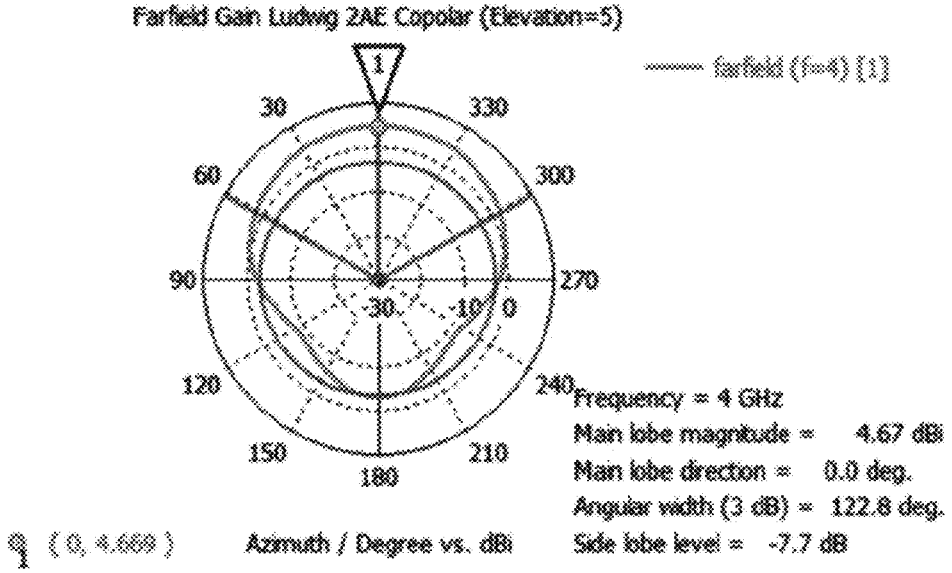
FIG. 6 shows a two-dimensional radiation pattern of the antenna of FIG. 3 in a plane of elevation of 5°.

This good directivity at low elevation is confirmed by the two-dimensional radiation pattern of the same antenna, again at a frequency of 4 GHz, in a plane of elevation of 5°, as illustrated in FIG. 6. This angle of elevation corresponds to the case of an antenna mounted on the lower portion of the fuselage of the aircraft (the axis Oz being substantially parallel to the longitudinal axis of the latter) and of a typical situation in which the aircraft is flying at an altitude of 3 km and the ground station is located about thirty km away.

The angular width in azimuth of the main lobe is more than 120°, this permitting communications with a high quality of service even when the ground station is not aligned with the heading of the aeroplane. It is therefore not necessary to carry out dynamic beam forming in order to get the beam to point in the direction of this station.

Furthermore, the radiation pattern contains few side lobes with a high rejection, this correspondingly decreasing the risk of reception-end interference.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A Yagi-Uda antenna comprising:

a radiating element, a reflecting parasitic element, at least one directing element, wherein the radiating element is disposed between the reflecting parasitic element and the at least one directing element, and wherein the radiating element is formed by a conductive plate, placed substantially orthogonal to a longitudinal axis of the antenna and above a ground plane to form a monopole, the plate being provided, on side of the ground plane, with a feed terminal for applying or receiving an antenna signal;

wherein the conductive plate is of circular, ellipsoidal or rectangular shape, wherein the conductive plate is equipped, at an end opposite to the ground plane, with a return conductor, the return conductor being electrically connected to the ground plane, so that an assembly comprising the conductive plate and the return conductor forms a folded monopole, wherein the conductive plate is formed as a disc of diameter of about $\lambda/4$, where $\lambda$ is a wavelength corresponding to a lower limit of an operating frequency band of the antenna, and wherein the return conductor takes the form of a rod or a strip of length substantially identical to the diameter of the disc.

2. The Yagi-Uda antenna according to claim 1, wherein the return conductor extends parallel to the disc and is located therebehind, between the disc and the reflecting parasitic element.

3. The Yagi-Uda antenna according to claim 1, wherein the return conductor extends parallel to the disc and is located in front thereof, between the disc and the directing element.

4. The Yagi-Uda antenna according to claim 1, wherein the reflecting parasitic element has, in a direction perpendicular to the ground plane, a dimension larger than that of the conductive plate in a same direction.

5. The Yagi-Uda antenna according to claim 1, wherein the at least one directing element is configured as a folded monopole, comprising a first conductive segment and a second conductive segment that are parallel to each other and to the conductive plate, said first and second conductive segments being connected at a common first end, on a side opposite to the ground plane, and not being connected at their second ends, on the side of the ground plane.

6. The Yagi-Uda antenna according to claim 5, wherein the conductive plate has a disc shape, and wherein the first and second conductive segments have a length smaller than a diameter of this disc.

7. The Yagi-Uda antenna according to claim 1, wherein an operating passband of the antenna covers more than one octave.

8. An aircraft, comprising the Yagi-Uda antenna according to claim 1, said antenna being mounted on a lower portion of a fuselage of the aircraft, the longitudinal axis of the antenna being substantially parallel to a longitudinal axis of the aircraft, and the ground plane comprising a skin of the fuselage.

9. A Yagi-Uda antenna comprising:

a radiating element, a reflecting parasitic element, at least one directing element, wherein the radiating element is disposed between the reflecting parasitic element and the at least one directing element, and wherein the radiating element is formed by a conductive plate, placed substantially orthogonal to a longitudinal axis of the antenna and above a ground plane to form a monopole, the plate being provided, on a side of the ground plane, with a feed terminal for applying or receiving an antenna signal;

wherein the at least one directing element is configured as a folded monopole, comprising a first conductive segment and a second conductive segment that are parallel to each other and to the conductive plate, said first and second conductive segments being connected at a common first end, on another side opposite to the ground plane, and not being connected at their second ends, on the side of the ground plane.

10. The Yagi-Uda antenna according to claim 9, wherein the conductive plate has a disc shape, and wherein the first and second conductive segments have a length smaller than a diameter of this disc.

* * * * *